US006132030A

United States Patent [19]

Cornell

[11] Patent Number: 6,132,030

[45] **Date of Patent: *Oct. 17, 2000**

[54] HIGH PRINT QUALITY THERMAL INK JET PRINT HEAD

[75] Inventor: Robert Wilson Cornell, Lexington, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/635,355

[22] Filed: Apr. 19, 1996

[51] Int. Cl.[7] ..... B41J 2/05

[52] U.S. Cl. ..... 347/57; 347/56; 347/62

[58] Field of Search ..... 347/62, 63, 65, 347/57, 56

[56] References Cited

U.S. PATENT DOCUMENTS

| | | | |
|---|---|---|---|
| 4,490,728 | 12/1984 | Vaught et al. | 347/60 |
| 4,675,693 | 6/1987 | Yano | 347/63 |
| 4,870,433 | 9/1989 | Campbell | 347/62 |
| 4,967,208 | 10/1990 | Childers | 347/47 X |
| 5,218,376 | 6/1993 | Asai | 347/61 |
| 5,305,015 | 4/1994 | Schantz et al. | 347/47 |
| 5,600,356 | 2/1997 | Sekiya | 347/62 |
| 5,710,583 | 1/1998 | Mitani | 347/62 |

OTHER PUBLICATIONS

S. Van Stralen and R. Cole, *Boiling Phenomena*, vol. 1, Chapter 3, McGraw Hill, New York, (1979).

A. Asai, "Bubble Dynamics Under High Heat Flux Pulse Heating," Proc. ASME/JSME, Thermal Conf., (1991).

W. Runge, "Nucleation in Thermal Inkjet Printer," Proc. 8th Int. Cong. Adv. Non–Impact Printing Tech., (1992).

*Primary Examiner*—John Barlow
*Assistant Examiner*—An H. Do
*Attorney, Agent, or Firm*—John A. Brady

[57] ABSTRACT

The invention described herein relates to a method for printing with a thermal ink jet printer. A thermal ink jet print head containing a plurality of resistance heaters is provided. To each resistance heater there is an electrical current path, and each resistance heater also has a surface for heating the ink adjacent the surface. By providing an electrical current to the heaters to heat the ink such that a heater power density of at least about two gigawatts per square meter is obtained, print quality may be dramatically improved.

19 Claims, 11 Drawing Sheets

HIGH PRINT QUALITY THERMAL INK JET PRINT HEAD

FIELD OF THE INVENTION

The present invention relates to ink jet print heads, and more particularly to a method for improving print quality.

BACKGROUND OF THE INVENTION

Thermal ink jet print heads are commonly used in a wide variety of printers. They operate by propelling a drop of ink from a nozzle in the print head in response to an electrical signal impulse. This is generally known as "drop on demand" printing. Typically, the print head will receive a signal in the form of an electrical current, which may be directed to a resistance heater element.

As the current passes through the resistance heater in a thermal ink jet print head, a small amount of ink on the surface of the heater element is heated. As the ink heats, a component of the ink, usually water, becomes superheated to the point that it vaporizes, creating a vapor bubble. The expansion of the vapor bubble produces a pressure pulse which imparts momentum to a portion of the ink, thereby propelling the ink through an ink ejection nozzle so that it impacts on the paper. By providing a plurality of ink ejection nozzles and heater elements associated therewith, and by timing the electrical signals to one or more heater elements, patterns of ink forming images, such as letters, can be produced on a substrate.

There are a number of factors which effect the quality of the images produced by a thermal ink jet print head. Among the factors are the characteristics of the resistance heaters, the properties of the ink and the geometry of the print head and ejection orifices. Printer manufacturers are constantly searching for techniques which may be used to improve print quality.

Print quality is related to how precisely the ejected ink droplet from the print head is placed on the substrate. Because the paper and the print head are typically moving with respect to each other as the ink is being ejected from the print head, the velocity with which the ink droplet is expelled from the print head orifice effects the placement of the droplet on the paper. It is traditionally believed that print quality is maximized by maximizing droplet velocity. Therefore, print head manufacturers have typically designed their print heads for maximum ink droplet velocity. One method of doing this is to control the heater power density at a point which achieves the maximum bubble wall velocity, which in turn imparts momentum to an ink droplet.

The power density of a resistance heater is the ratio between the amount of power sent to the heater, and the surface area of the heater. A graphical relationship between droplet velocity and power density shows that droplet velocity is maximized at a power density of between about 1.1 gigawatts per meter squared and about 1.7 gigawatts per meter squared of heater surface area. At power densities either greater than or less than this range, droplet velocity decreases. Thus, manufacturers typically design their print heads to operate within this range.

The power density of the heater also tends to have an inverse relationship with nucleation time, or in other words the time required to vaporize a portion of the ink. At relatively low power densities nucleation time is increased, and at relatively high power densities nucleation time is reduced.

A longer nucleation time is traditionally preferred, as more time is thereby provided to transfer energy from the heater to the liquid phase of the ink before the vapor phase separates the liquid ink from the surface of the heater element. By imparting more energy to the liquid ink, it is typically thought that bubble growth is better sustained, and produces a more consistent expulsion of the liquid ink, and hence better print quality. Therefore, print head manufacturers tend to design print heads that work at as low a power density as possible, yet at a power density just great enough to achieve the maximum drop velocity, as described above. An exception is the ExecJet IIc printer, which has a power density of 1.89 gigawatts per square meter ($GW/m^2$). Although the power density of that printer is attributable to the inventor of this application, that printer is prior art as it has been sold for more than a year.

With regard to the foregoing, it is an object of the present invention to improve the print quality of a thermal ink jet printer.

Another object of the present invention is to reduce the drop placement variation of ink ejected from a thermal ink jet printer.

Still another object of the present invention is to provide an improved method for operating a thermal ink jet printer so that ink droplet placement variation is minimized.

SUMMARY OF THE INVENTION

In view of the foregoing and other objects, the present invention provides a method for printing with a thermal ink jet printer. The method comprises providing a thermal ink jet print head containing a plurality of resistance heaters. Each resistance heater has a length, an electrical current path and a surface for heating the ink adjacent the surface. The ink is heated by providing electrical current to the heater through the current path, the equation being the well know current squared times resistance, termed Joule law heating. An electrical current is provided such that a heater power density of at least about two gigawatts per square meter is obtained.

Despite providing print head heaters which are operated at a power density which is greater than that which produces the maximum droplet velocity, it has been found that print quality is dramatically increased. It is believed that improved print quality is obtained because the print head is operated in a range where droplet velocity does not vary dramatically with small changes in power density. Thus a droplet from a print head fashioned according to the present invention may be propelled with a more uniform velocity than a droplet from a prior art print head. Surprisingly, velocity uniformity has been found to be a more important factor in print quality than maximum droplet velocity.

Accordingly, the present invention improves print quality by operating the print head at a power density which is greater than that which produces the maximum droplet velocity. Thus, the present invention defies conventional wisdom in two important ways, by using neither the maximum droplet velocity, nor the lowest power density which achieves maximum droplet velocity.

In another embodiment, the present invention provides a thermal ink jet print head comprising a plurality of resistance heaters having a planar surface ranging in size from about 25 microns long and about 25 microns wide to about 65 microns long and about 65 microns wide. Connected to each resistance heater is an electrical conduit for providing electrical current to the heaters. An electrical current is provided so that it passes through the conduit to the heaters at a power density of at least about two gigawatts per square meter of heater surface area.

BRIEF DESCRIPTION OF THE DRAWINGS

Further objects and advantages of the invention will become apparent by reference to a detailed description of preferred embodiments when considered in conjunction with the following drawings, wherein.

DESCRIPTION OF THE PREFERRED EMBODIMENTS

Figure 1:
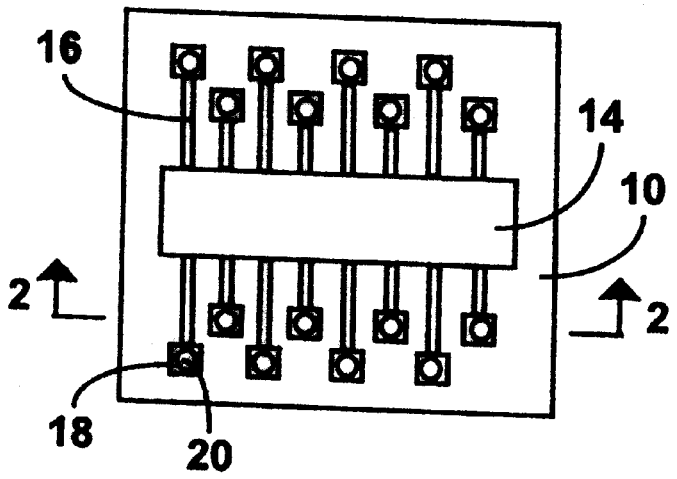
FIG. 1 is a top plan view of a thin film print head.

A thermal ink jet print head is comprised of several parts, acting in cooperation to produce a printed image on a substrate. The major components are an ink reservoir and a thin film print head. The ink reservoir provides the supply of ink to the print head. Referring now to the drawings, there is depicted in FIG. 1 a print head 10. The print head 10 receives the ink from a reservoir (not depicted) through an inlet 14 to ink supply channels 16, which provide the ink to the bubble chambers 18.

Disposed in or adjacent to the bubble chambers are resistive heaters (not depicted), which are typically planar in configuration. The heaters preferably have a rectangular surface configuration, ranging in size from about 25 microns square to about 65 microns square. An electrical current path, or conduit (not depicted), supplies electrical current to the heater from an electrical current source.

Figure 2:
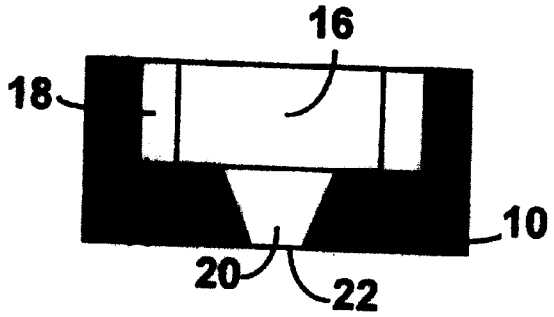
FIG. 2 is a cross-sectional view of a nozzle taken at section 2 in FIG. 1.

The bubble chambers 18 are in communication with a nozzle plate, in which a plurality of nozzles 20 are formed. Each nozzle 20 has an orifice 22, depicted in FIG. 2, through which the ink is expelled from the print head 10, toward the substrate. The nozzle orifices 22 preferably have a diameter of about 0.8 times the length of the heater, and are most preferably bell shaped, having a diameter which ranges from about twenty microns to about fifty-two microns through the nozzle plate.

Figure 3:
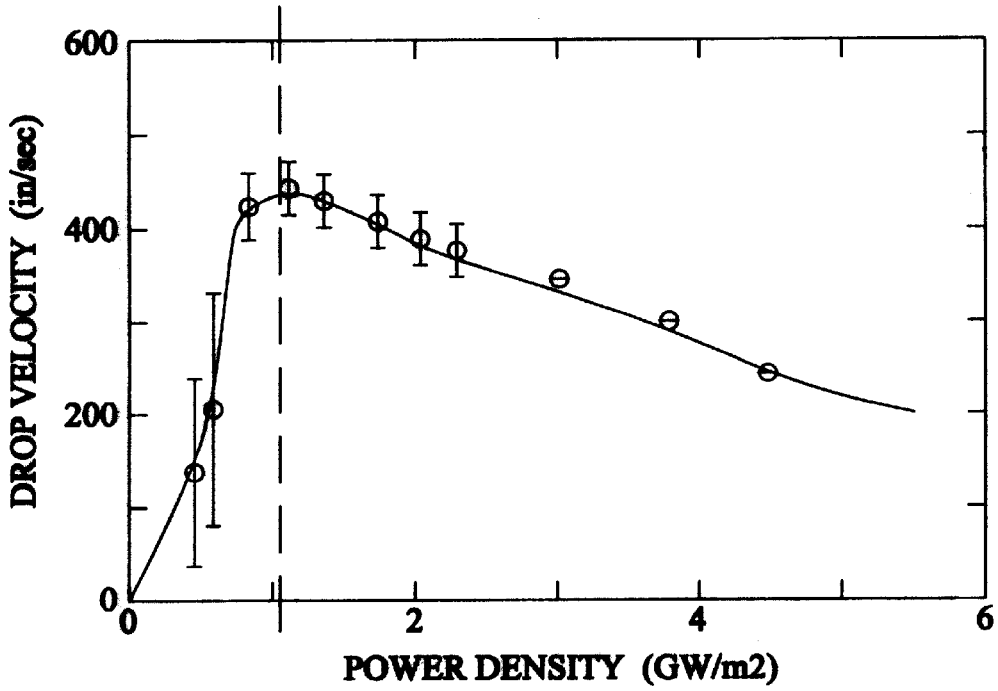
FIG. 3 is a graphical representation of droplet velocity versus heater power density.

There is depicted in FIG. 3 a graphical representation of a typical relationship between droplet velocity and heater power density. Along the abscissa is graphed increasing power density, expressed in units of gigawatts per meter squared ($GW/M^2$). Along the ordinate is graphed increasing drop velocity, expressed in units of inches per second (in/sec).

At a power density of zero there is, of course, no droplet velocity at all, as none of the ink is heated, vaporized, or expelled from the print head until the heaters are energized. Applying a small amount of energy to the heaters results in the ink being expelled from the heater. In the lower power density range, designated as section A in FIG. 3, a very small incremental increase in power density results in a relatively large increase in droplet velocity. This can be seen graphically as a large positive slope in the curve in the low power density range. The power density range where this tendency is exhibited in FIG. 1 is from about zero $GW/M^2$ to about 1.1 $GW/M^2$.

It will be appreciated that the curve depicted in FIG. 3 is representative only. In other words, while the general shape and characteristics of the curve depicted may be similar for all thermal ink jet print heads, variables such as heater size, ink formulation, and nozzle construction will affect the placement of the exact coordinates where the described features of the curve may be found. For example, while the maximum velocity of the ink droplet on the curve depicted in FIG. 3 is located at a power density of approximately 1.1 $GW/M^2$, other print heads using a different ink may produce a maximum droplet velocity at a power density of anywhere between about 1.1 $GW/M^2$ and about 1.7 $GW/M^2$.

After reaching maximum velocity, further increase in the power density produces a reduced velocity of the expelled ink droplet. In this range, designated as section B in FIG. 3, a very small incremental increase in power density results in a relatively small decrease in droplet velocity. This can be seen graphically as a small negative slope in the curve for the high power density range, which in FIG. 3 is above about 1.1 $GW/M^2$. As mentioned above, different print head and ink combinations will affect the exact power density at which this tendency commences, but the onset of this section B of the curve typically occurs at a power density of anywhere between about 1.1 $GW/M^2$ and about 1.7 $GW/M^2$.

The vertical lines bisecting some of the points on the graph, and which end in short horizontal lines, are range bars. The curve is a composite of several data sets, where each point on the curve represents the average of the corresponding data point from each set. The range bars indicate the degree of variability between the data sets collected.

The data points in section A of the curve, where a large positive slope is evident, exhibit a relatively large degree of variability. This is depicted as range bars that are relatively long. The data points in section B of the curve, where a small negative slope is evident, exhibit a relatively small degree of variability. This is depicted as range bars that are relatively short. As power density increases in section B of the curve, variability decreases to the point where range bars are not required on the data points.

Thus, in section A of the curve depicted in FIG. 3, the relationship between power density and droplet velocity has a high degree of unpredictability. However, in section B of the curve, for power densities greater than that which produces the maximum droplet velocity, the relationship between power density and droplet velocity has a relatively low degree of unpredictability.

As previously stated, the point at which droplet velocity is maximized is between about 1.1 gigawatts per meter squared and about 1.7 gigawatts per meter squared. Manufacturers typically design their print heads to operate within this range, as discussed above. Table 1 lists the power density at which several commercially available print heads are designed to operate.

TABLE 1

| Print head | Power Density ($GW/M^2$) |
|---|---|
| DESKJET black | 1.15 |
| DESKJET color | 1.34 |
| XEROX | 1.54 |
| CAN0N BJC600 | 1.23 |
| HP1600 black | 1.47 |
| HP1600 Color | 1.62 |
| EXECJET IIc | 1.89 |

As can be seen in Table 1, most, if not all of the currently available print head heaters are operated at a power density within the range of about 1.1 gigawatts per meter squared to about 1.7 gigawatts per meter squared. (Although the Exec-Jet IIc printer is prior art, since it has been on sale for a year, the power density selection of that printer is attributable to the inventor of this application.)They also tend to be near the lower end of this range. As previously discussed, lower power densities tend to allow the liquid component of the ink to absorb more thermal energy prior to vaporization, which is typically believed to benefit print quality. Therefore, the power densities at which manufacturers design their print heads to operate, tend to fall within section A of their specific power density—droplet velocity curves.

However, as is seen in section A of FIG. 3, operating in the range of power densities near or below that which provides the maximum droplet velocity results in a relatively large change in droplet velocity in response to relatively small changes in power density. Hence there is a greater degree of unpredictability of droplet velocity in this range, as indicated by the large range bars, which translates into reduced print quality.

While power density could be precisely controlled, to do so may require additional circuitry and components, which would add size, weight, and cost to the print head. Thus, manufacturers tend to have not taken extra precautions to precisely control power density. As a result, print heads are typically designed to expel the ink at relatively high velocities, but at velocities which have a relatively great degree of variability.

As the power density is increased above that which produces the maximum droplet velocity, it has been found that the change in droplet velocity changes surprisingly slowly in response to changes in power density, as discussed above. Thus, according to the present invention, a print head which operates in section B of the curve tends to produce droplets with relatively reduced velocity, but with significantly less variability in droplet velocity.

Figure 4:
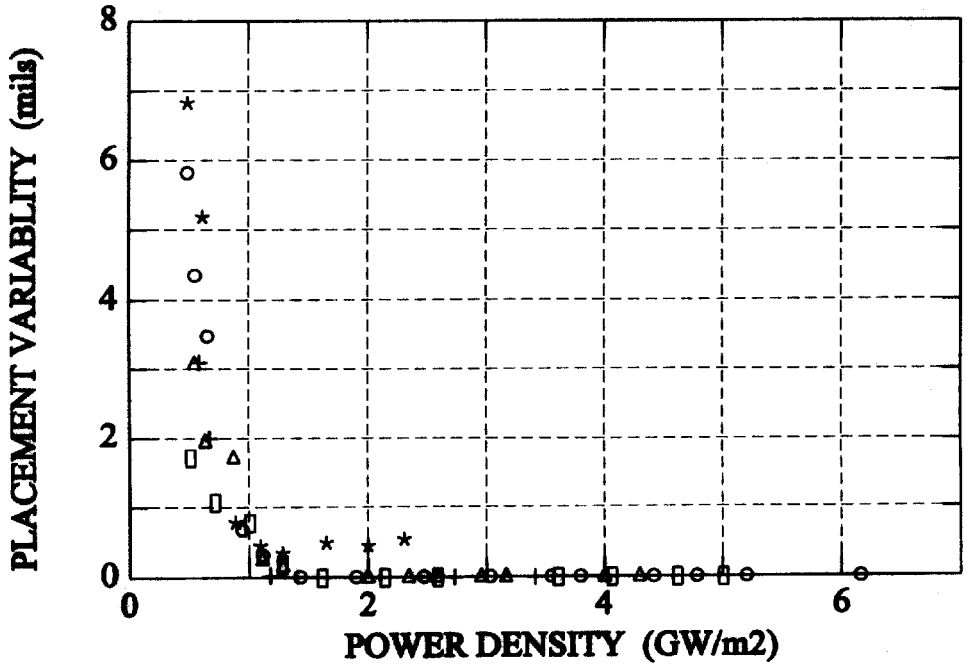
FIG. 4 is a graphical representation of ink droplet placement variation versus power density.

Referring now to FIG. 4, there is graphed the relationship between power density and droplet placement variation, or print quality. Along the abscissa is graphed increasing power density, expressed in units of $GW/M^2$. Along the ordinate is graphed increasing ink droplet placement variability (the inverse of print quality), expressed in units of thousandths of an inch (mils). Five different data sets are graphed in FIG. 4, depicted by asterisks, circles, triangles, plus signs, and squares. The different data sets represent different print head configurations and ink formulations. As can be seen, each of the five different data sets track each other with a surprisingly high degree of correlation.

FIG. 4 graphically illustrates that print quality starts out quite low, or in other words placement variability is quite high, at low power densities corresponding to the power densities found within section A of the curve depicted in FIG. 3. As the power density increases to the power density which yields the maximum droplet velocity, the placement variability decreases dramatically, or in other words print quality is significantly increased.

At power densities in excess of about 2.0 $GW/M^2$, which is appreciably above the range at which maximum droplet velocity is typically attained, placement variability asymptotically approaches zero. It has thus been discovered that, contrary to conventional wisdom, print quality is maximized at a velocity which is lower than the maximum droplet velocity. In accordance with this discovery, print heads according to a preferred embodiment of the present invention are designed to operate at a power density which is greater than about 2.0 $GW/M^2$.

Figure 5:
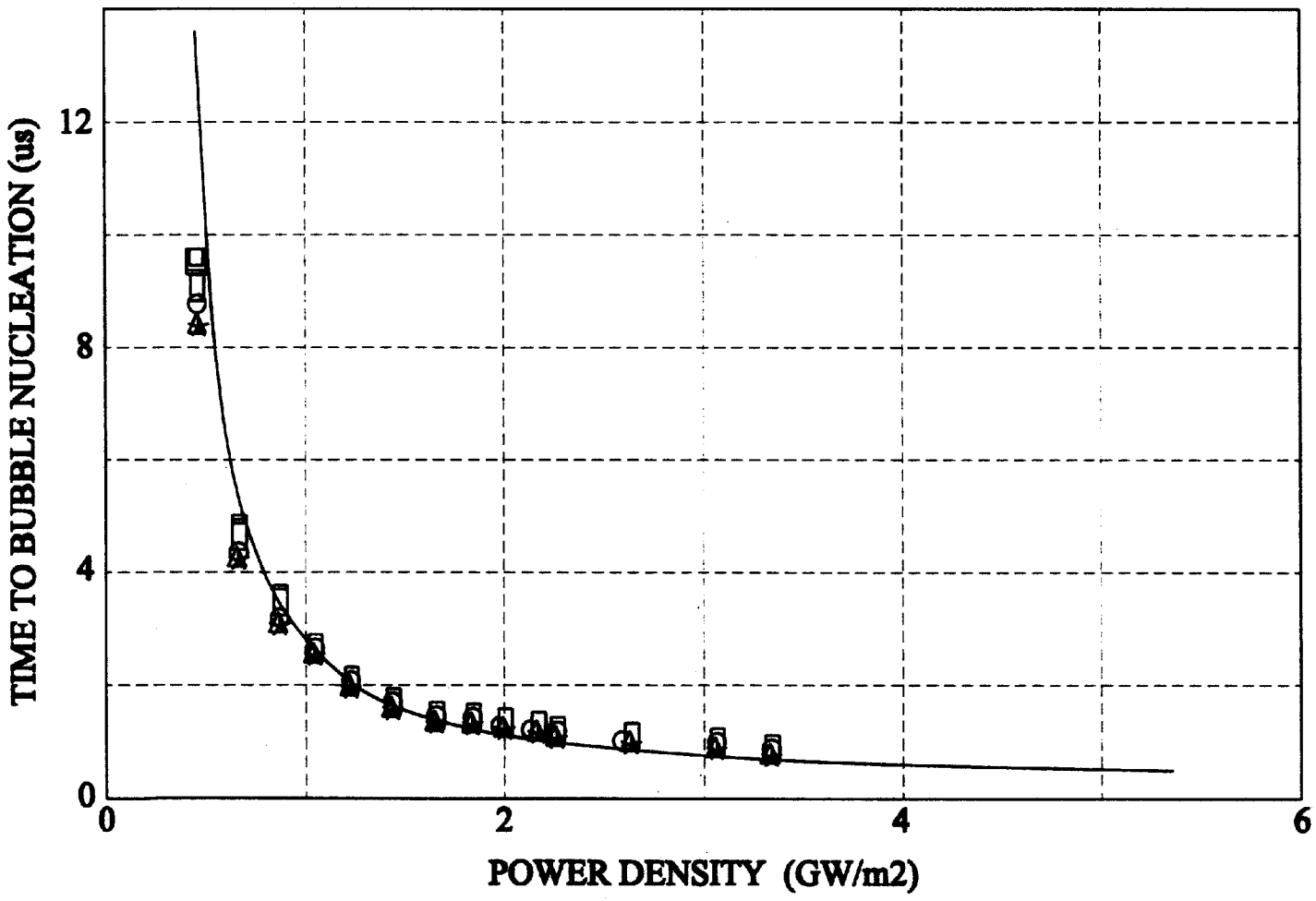
FIG. 5 is a graphical representation of power density versus heating time.

FIG. 5 depicts the empirical relationship between power density and the heating time required to produce bubble nucleation. Bubble reliability R(t), or the probability of nucleation occurring during the fire pulse (which is the time during which electrical current is provided to the heater), is defined by the following equation:

$$R(t) = 1 - e^{-\int_0^{t_p} \lambda(t)\,dt} \tag{1}$$

where $t_p$ is the time duration of the fire pulse. When R(t) equals 1, bubble nucleation occurs. Nucleation rate $\lambda(t)$ is defined by the following equation:

$$\iiint_{volume} J_{HO}(T(x, y, z, t))\,dV \tag{2}$$

where $$J_{HO} = Ae^{-\frac{\Delta H}{KT}} \tag{3}$$

$$A = \frac{N_A \rho}{m}\sqrt{\frac{3N_A\sigma}{\pi m}} \tag{4}$$

$$\Delta H = \frac{16\pi\sigma^3}{3(P_e - P_{amb})^2} \tag{5}$$

$$P_e = P_v e^{\frac{(P_{amb}-P_v)m}{\rho N_A KT}} \tag{6}$$

T=temperature in ° K.,
x=first position coordinate,
y=second position coordinate,
z=third position coordinate,
t=time,
V=volume,
ΔH=activation energy in joules (J),
K=Boltzmann constant=$1.3807\times10^{-23}$ in J/° K.,
$N_A$=Avogadro number=$6.022\times10^{23}$/mol,
σ=liquid—air surface tension in N/m,
m=liquid molar weight in Kg/mol, $\rho$=liquid density in $Kg/m^3$, $P_e$=equilibrium bubble pressure in pascals (Pa), $P_{amb}$=ambient pressure in Pa, and $P_v$=vapor pressure in Pa.

This indicates that bubble reliability may be dependant on nucleation rate, which is dependant on the properties of the ink and the temperature profile across the surface of the heater as it changes with time. The temperature profile may be described by the unsteady state conduction equation:

$$\frac{\partial^2 T}{\partial x^2}+\frac{\partial^2 T}{\partial y^2}+\frac{\partial^2 T}{\partial z^2}+q=\frac{1}{\alpha}\frac{\partial T}{\partial t}=\nabla^2 T+q \tag{7}$$

where q=internal energy generation, and $\alpha$=thermal diffusivity in $m^2/s$.

FIG. 5 is a graph of the above equations solved for time (t), using the properties for water. Also plotted in FIG. 5 is the empirical data for several ink and heater combinations. It is noted that there is a high degree of correlation between the theoretical water data and the empirical ink data. However, the above equations do not clearly define why the velocities of region B in FIG. 3 exhibit less variability than those of region A. Without intending to be limited by theory, possible explanations are presented for why ink drop velocities decrease with increasing power density in section B of FIG. 3, and why ink drop velocities decrease with decreasing power density in section A of FIG. 3. The differences between the theoretical mechanisms controlling different portions of the curve are then discussed in light of why one may be inherently more erratic than the other.

When a current corresponding to the high power density region B of FIG. 3 is passed through a heater, the surface temperature of the heater climbs relatively rapidly, thereby heating the ink adjacent to the surface of the heater. When the ink reaches its superheat limit (approximately 330° C.), it nucleates, or explodes into vapor. After nucleation, a bubble growth phase begins.

During bubble growth, an insulating blanket of ink vapor expands, which tends to thermally disconnect the ink above it from the heater surface. While some convection of thermal energy may occur across the vapor bubble, it tends to be insignificant in comparison to the thermal energy which can be transferred to the ink by conduction directly from the heater surface. Thus, bubble growth may essentially be sustained entirely by the thermal energy received from the heater and stored in the ink prior to nucleation.

When a heater is operated in the high power density region B of FIG. 3, the time delay between the onset of the fire pulse and nucleation of the ink generally decreases, as shown in FIG. 5. Thus, less thermal energy is conducted from the heater to the ink to sustain bubble growth, which tends to reduce the duration of the pressure pulse, or in other words the length of time during which the bubble pressure is greater than one atmosphere.

Figure 6A:
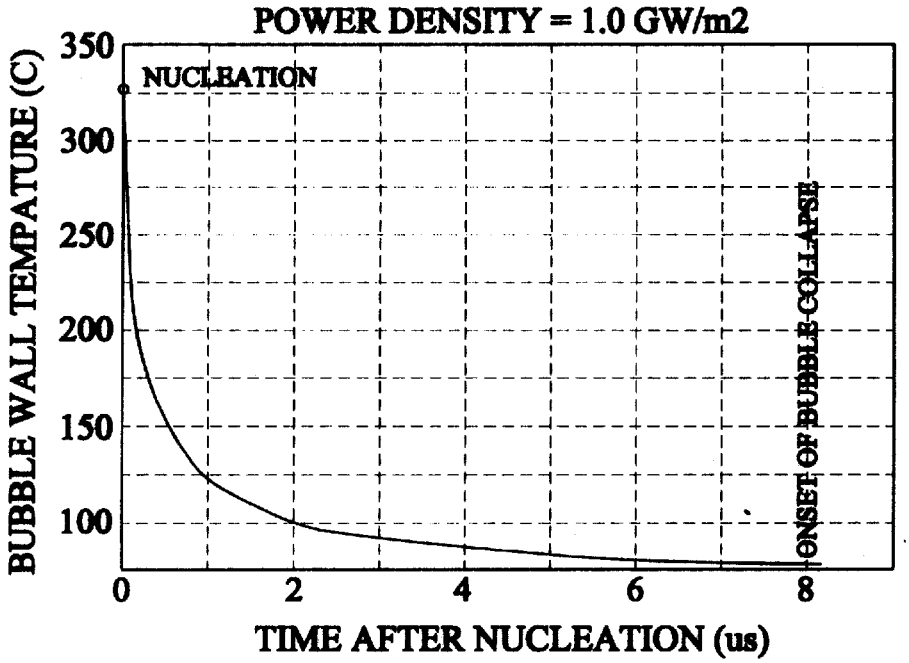
FIG. 6A is a graphical representation of bubble wall temperature versus time at a first power density.
Figure 6B:
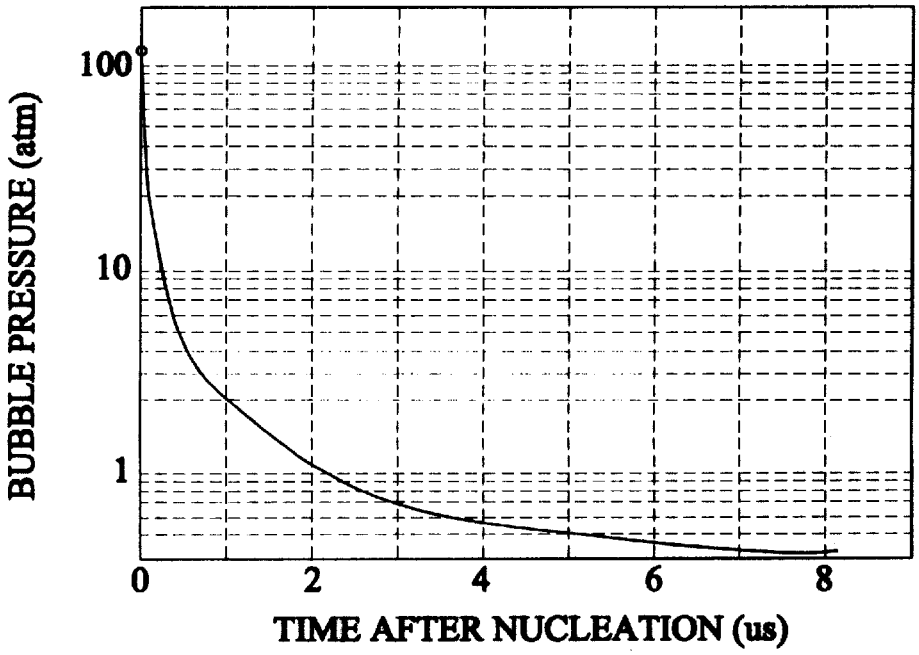
FIG. 6B is a graphical representation of bubble pressure versus time at a first power density.
Figure 7A:
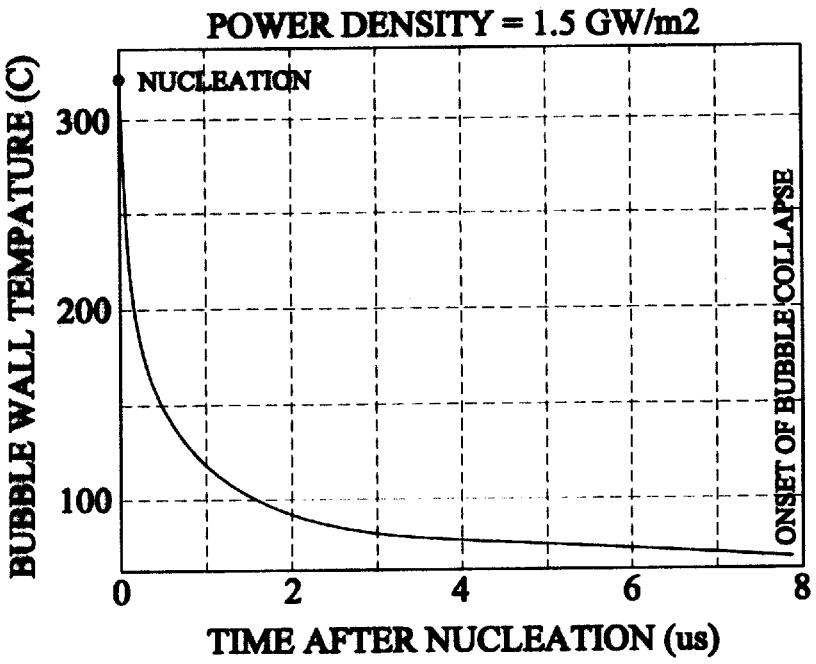
FIG. 7A is a graphical representation of bubble wall temperature versus time at a second power density.
Figure 7B:
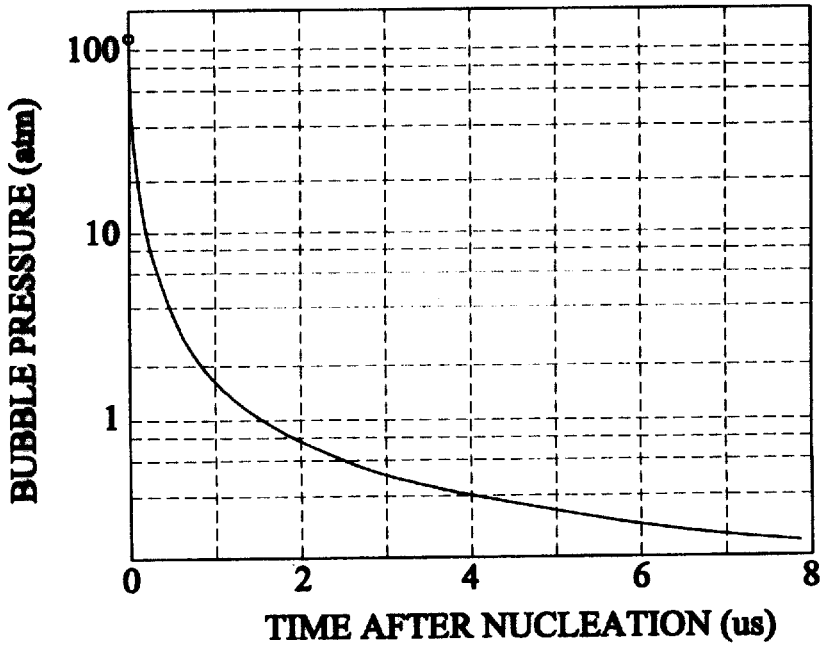
FIG. 7B is a graphical representation of bubble pressure versus time at a second power density.
Figure 8A:
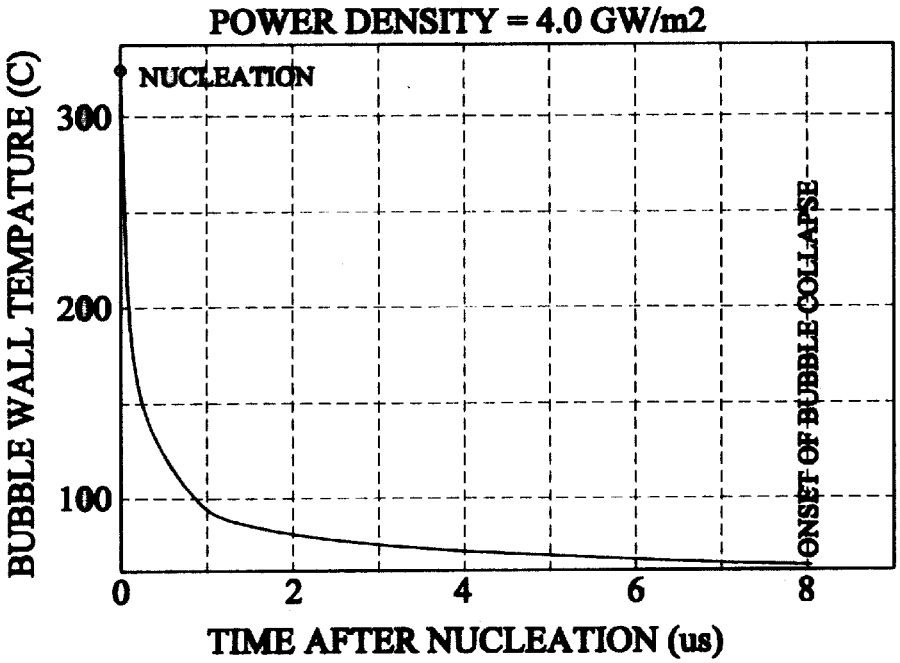
FIG. 8A is a graphical representation of bubble wall temperature versus time at a third power density.
Figure 8B:
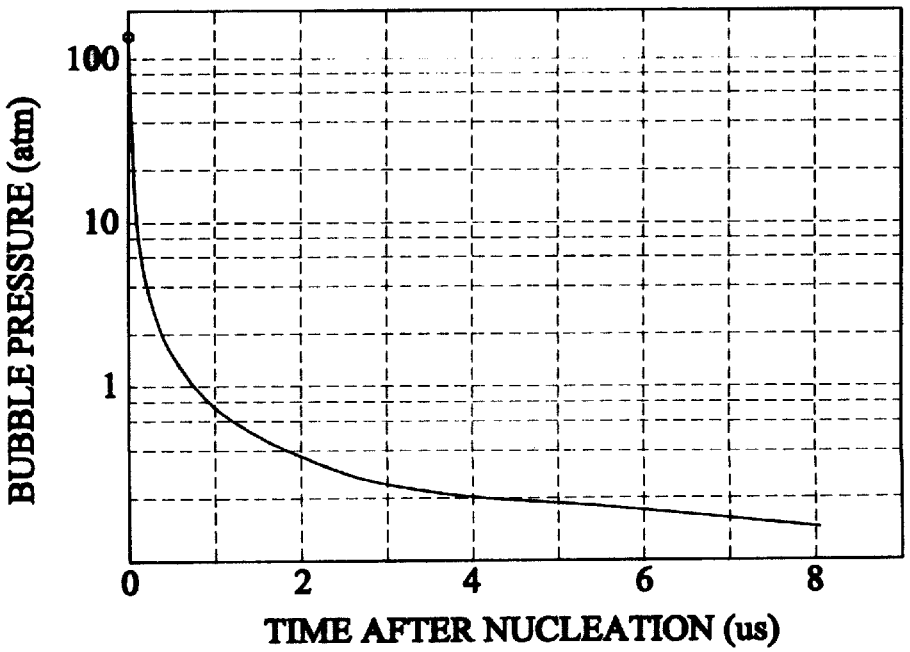
FIG. 8B is a graphical representation of bubble pressure versus time at a third power density.

This trend may be seen by comparing FIGS. 6, 7, and 8. In FIG. 6B, which represents the characteristics of a heater operated at a power density of 1.0 $GW/m^2$, the bubble pressure falls below one atmosphere at approximately two microseconds after nucleation. In FIG. 7B, which represents the characteristics of a heater operated at a power density of 1.5 $GW/m^2$, the bubble pressure falls below one atmosphere at approximately 1.5 microseconds after nucleation. Finally, in FIG. 8B, which represents the characteristics of a heater operated at a power density of 4.0 $GW/m^2$, the bubble pressure falls below one atmosphere at approximately 0.75 microseconds after nucleation.

Figure 9:
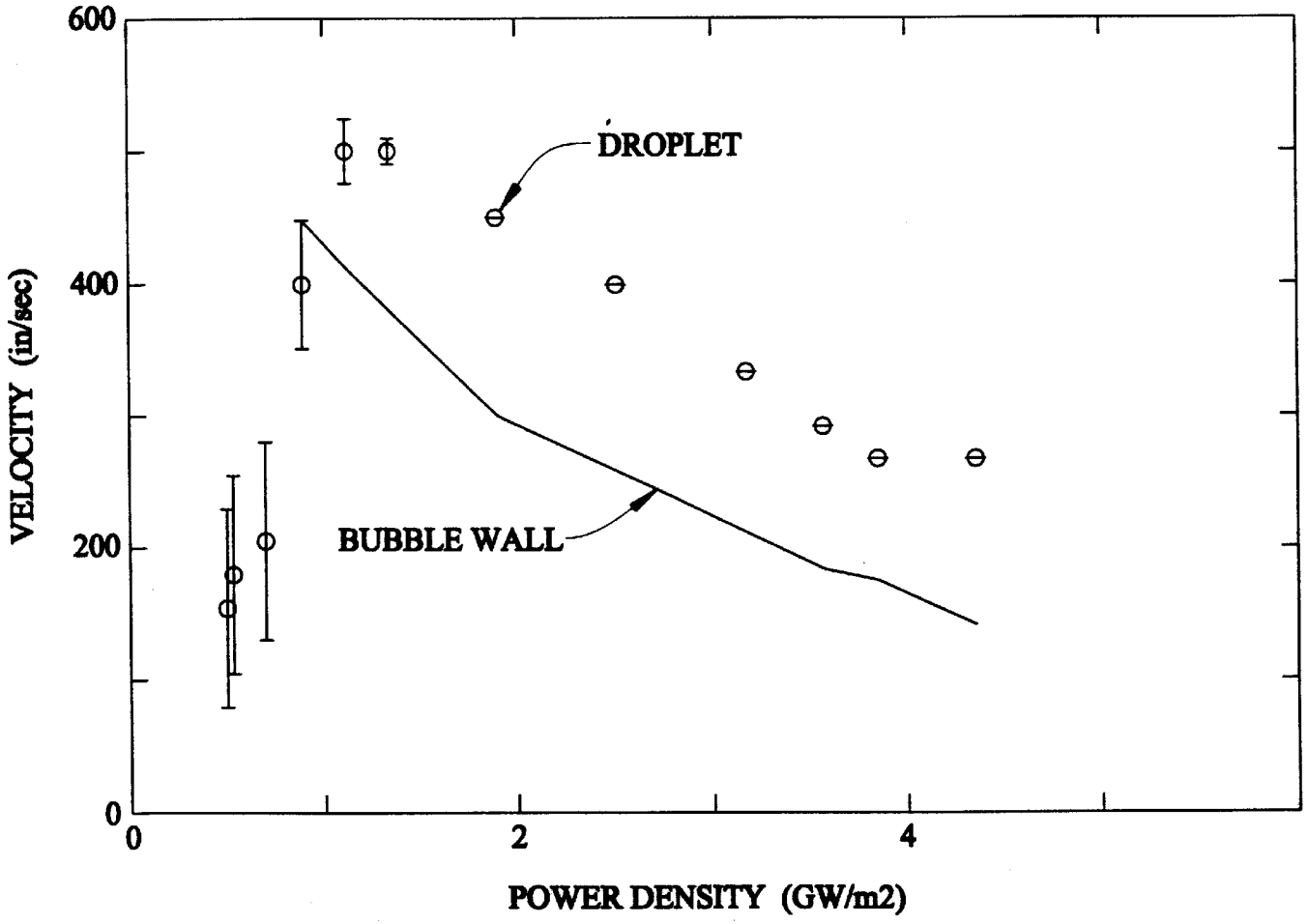
FIG. 9 is a graphical representation of bubble wall velocity versus power density.

The reduced duration of the pressure pulse may cause a lower bubble wall velocity, which in turn may reduce the velocity of the ejected ink droplet, as depicted in FIG. 9. It is noted that the difference between the bubble wall velocity and droplet velocity may be due at least in part to the nozzle orifice having an opening that is typically smaller than the surface area of the heater, thereby creating a higher exit velocity for the droplet.

To summarize, one possible interpretation of the theorized and observed conditions described above is that the reduced ink droplet velocity produced by ink jet print heads operated in the high power density region B of FIG. 3 is a result of reduced bubble wall velocity, which may be due to short duration pressure pulses. Short duration pressure pulses may be caused by less thermal energy transferred by conduction from the heater to the ink, which in turn may be caused by reduced nucleation time. Thus, one possible explanation has been presented for why the velocity of an ink drop decreases as the power density increases for an ink jet print head operated in the high power density region B of FIG. 3.

Figure 10:
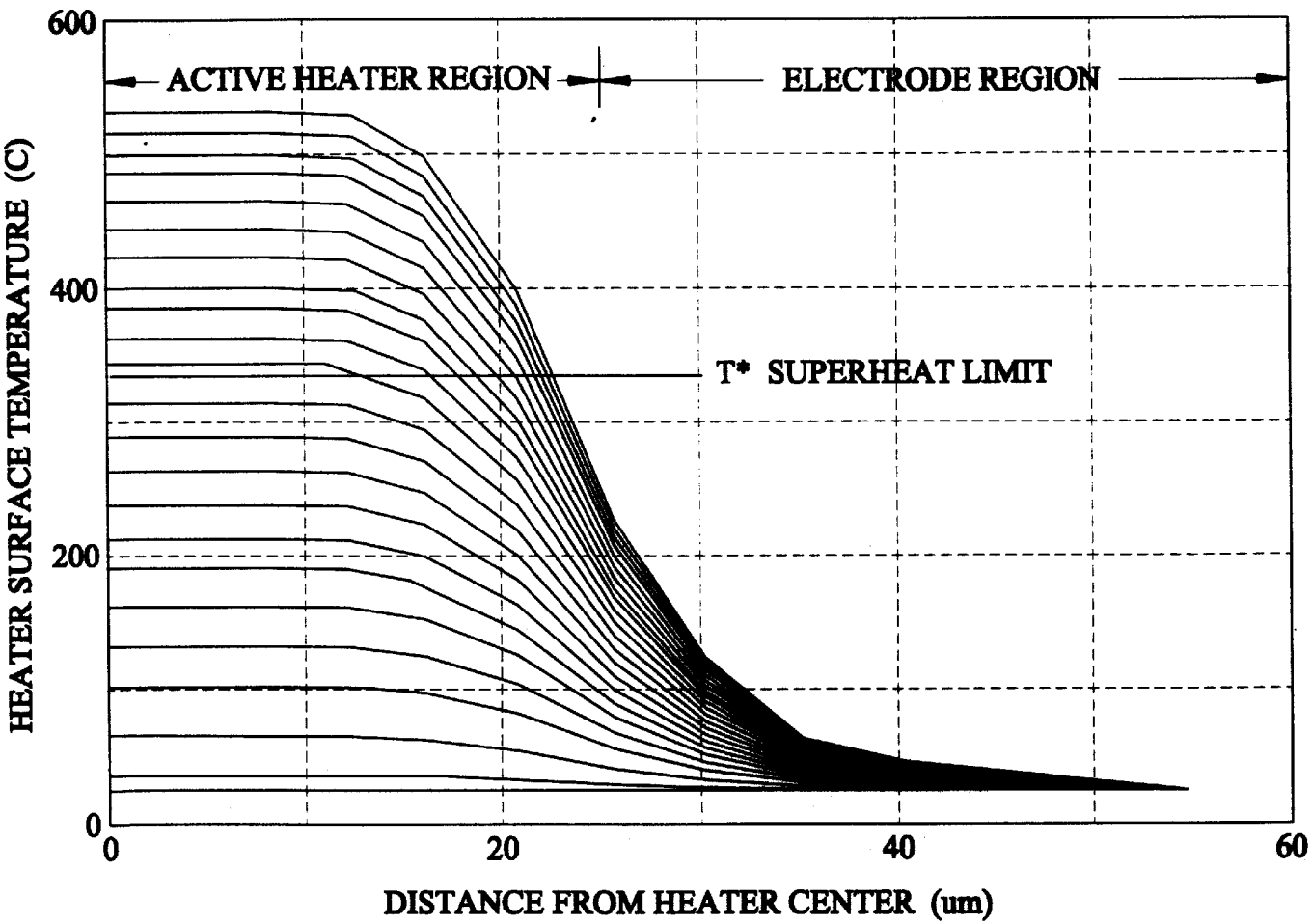
FIG. 10 is a graphical representation of heater surface temperature versus distance from heater center.

However, it is believed that the decrease in ink drop velocity associated with decreasing power density in region A of FIG. 3 may be the result of a different mechanism than that described above. Heaters tend to be hotter in the center, and cooler at the edges, because thermal energy tends to be conducted away from the heater by the materials adjacent to its edges. Two dimensional heat transfer simulations, such as that depicted in FIG. 10, show this tendency. This indicates that the ink over the entire surface of a heater will not reach its superheat temperature at the same instant, but the ink over the center of the heater will tend to reach the superheat temperature sooner than the ink over the edges of the heater.

Figure 11:
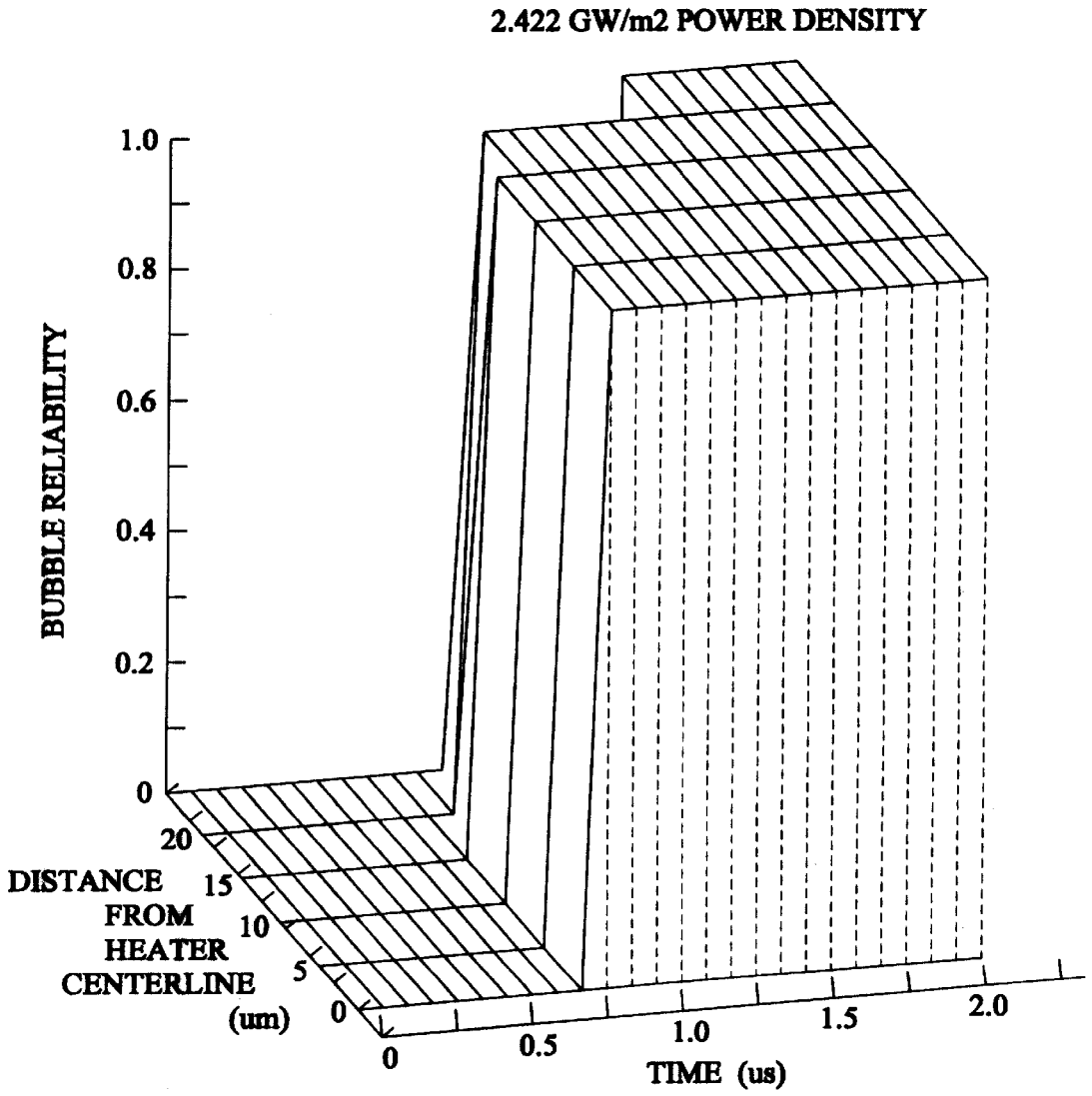
FIG. 11 is a three-dimensional graphical representation of bubble reliability versus time versus distance from heater centerline at a first power density.
Figure 12:
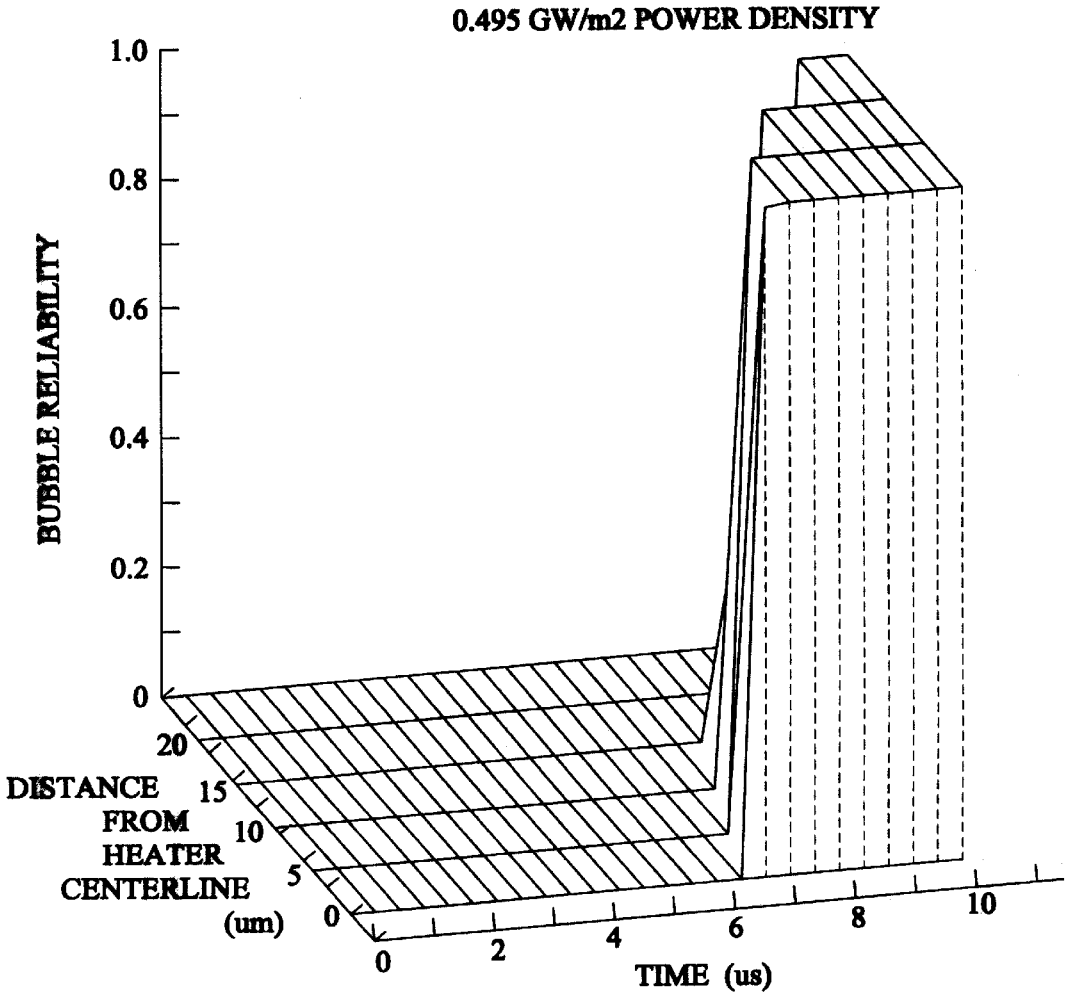
FIG. 12 is a three-dimensional graphical representation of bubble reliability versus time versus distance from heater centerline at a second power density.

Bubble reliability, R(t) as defined above, can be plotted as a function of distance from the center of the heater and length of time from the fire pulse, for various power densities, as depicted in FIGS. 11 and 12. FIG. 11 depicts bubble reliability for a heater operated in the high power density section B of FIG. 3, and FIG. 12 depicts bubble reliability for a heater operated in the low power density section A of FIG. 3.

As previously discussed, the onset of nucleation occurs relatively quickly in the high power density model depicted in FIG. 11, as compared to the low power density model depicted in FIG. 12. However, in the high power density model depicted in FIG. 11, a relatively greater percentage of the surface of the heater produces nucleation in the ink at the same time. In the low power density model depicted in FIG. 12, a relatively lesser percentage of the surface of the heater produces nucleation in the ink at the same time. Thus, the nucleation process may tend to be spread over a longer period of time in the low power density case.

Therefore, reducing the power density in section A of FIG. 3 may reduce ink drop velocity because less of the heater surface produces nucleation at a given point in time, thus imparting less momentum to the ink. Therefore, the mechanism responsible for the decrease in velocity associated with the decrease in power density in section A of FIG. 3, may be different than the mechanism responsible for the decrease in velocity associated with the increase in power density in section B of FIG. 3.

Further, while each of the two proposed mechanisms may affect the characteristics of the velocity—power density curve in both sections A and B of FIG. 3, it is suggested that one of the mechanisms may be predominant in one section of the curve, and the other mechanism may be predominant in the other. The following discussion provides a possible answer as to why one of these two postulated mechanisms tends to produce greater variability in the velocity of the expelled ink drop.

Ideally, the entire heater surface has a bubble reliability of 1, or in other words produces nucleation in the ink, at the same instant. This ideal appears to be more fully realized when a heater is operated at higher power densities, such as those corresponding to section B of FIG. 3. Once nucleation begins, typically in the center of the heater as described above, there is a race between the advancing bubble wall and the temperature wave on the surface of the heater, each of which tends to radiate out from the center of the heater to the edges of the heater.

As discussed above, if the velocity of the bubble wall is greater than the velocity of the temperature wave, then the vapor bubble tends to thermally disconnect the liquid ink from the heater surface before the heater surface can reach a temperature at which adequate thermal energy can be conducted from the heater surface to the liquid ink. However, if the velocity of the temperature wave from the center of the heater to the edges of the heater is greater than the velocity of the bubble wall, then the heater will have time to reach an adequate temperature and conduct sufficient heat to the liquid ink to sustain bubble growth before being thermally disconnected.

Nucleation Quality (Q), a new discovery and term disclosed for the first time herein, may be used to describe the race between the advancing bubble wall and the heater temperature wave. "Nucleation Quality" is defined as the ratio between the length of heater surface at which bubble reliability equals 1 (as measured from the center of the heater out toward the edges, and designated as L*), and the total length of the heater surface (as measured from the center of the heater to the edges, and designated as $L_H$). Nucleation Quality is given in equation form as:

$$Q = \frac{L^*}{L_H} \tag{8}$$

"Not Quality" is defined as the ratio between the length of heater surface at which bubble reliability is less than 1 (as measured from the edge of the heater in toward the center, and designated as L), and the total length of the heater surface. "Not Quality" is given in equation form as:

$$\overline{Q} = \frac{L}{L_H} \tag{9}$$

$$\overline{Q} = 1 - Q \tag{10}$$

Writing "Not Quality" as a rate equation produces the following equation:

$$\frac{\Delta\overline{Q}}{\Delta t} = \frac{L(t+\Delta t) - L(t)}{\frac{L_H}{\Delta t}} = \frac{1}{L_H}\frac{\partial L(t)}{\partial t} = \frac{\partial \overline{Q}}{\partial t} \tag{11}$$

Heater activation rate is given by the equation:

$$\beta(t \to t+\Delta t) = \frac{L(t) - L(t+\Delta t)}{\frac{L(t)}{\Delta t}} = -\frac{1}{L(t)}\frac{\partial L(t)}{\partial t} \tag{12}$$

Combining equation (11) and equation (12) yields:

$$\beta(t) = \frac{-1}{\overline{Q}}\frac{\partial \overline{Q}}{\partial t} \tag{13}$$

Integrating equation (13) over the fire pulse ($t_p$) with initial conditions $L(0)=L_H$ and $Q(0)=1$ yields:

$$\overline{Q} = e^{-\int_0^{t_p}\beta(t)\partial t} \tag{14}$$

which by equation (10) yields a description of Nucleation Quality as a function of time, given by the equation:

$$Q = 1 - e^{-\int_0^{t_p}\beta(t)\partial t} \tag{15}$$

The term $$\int_0^{t_p}\beta(t)\partial t \tag{16}$$

describes how nucleation may spread across the heater surface. The term can be solved by numerically integrating equation (12) over the time duration of the fire pulse.

Figure 13:
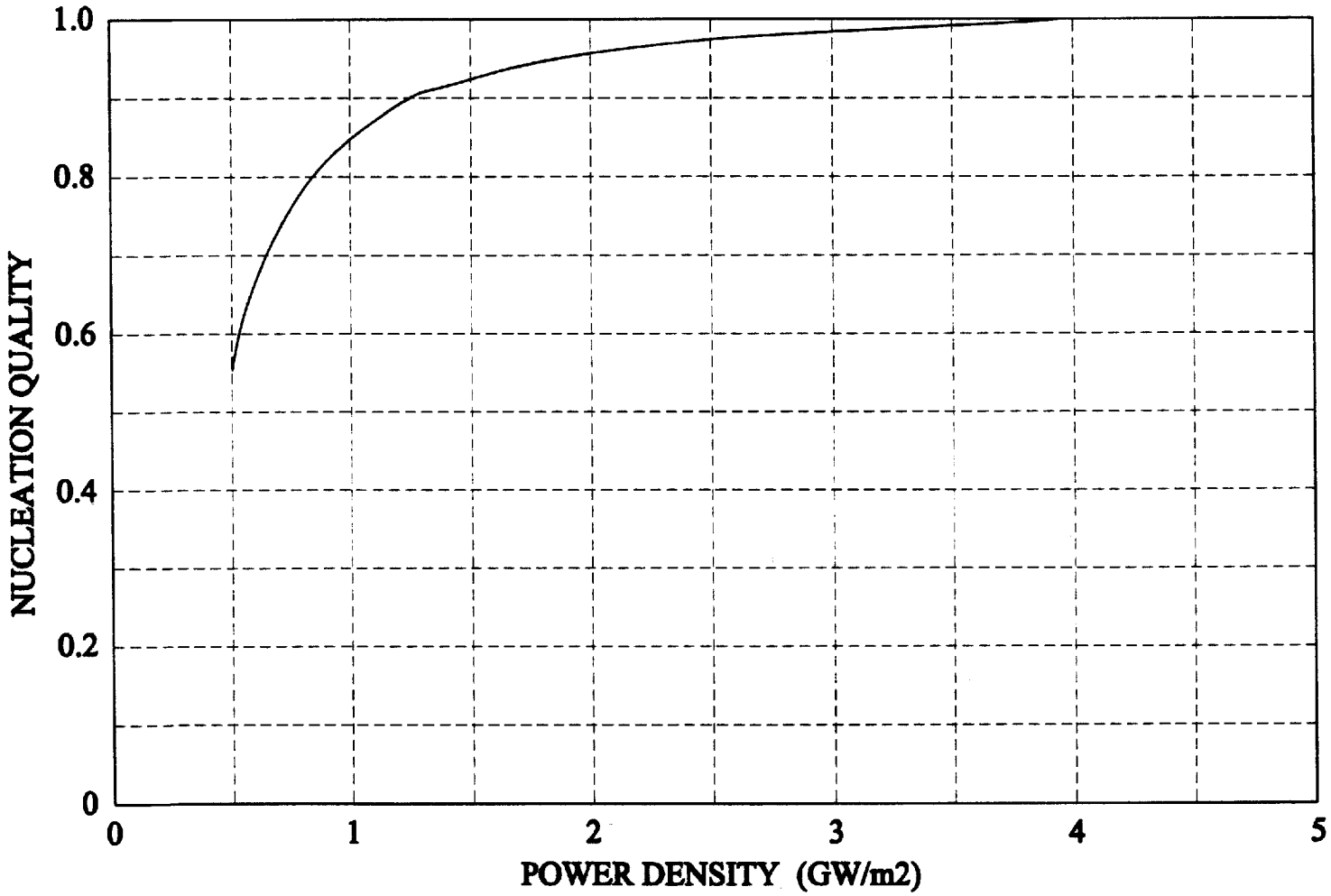
FIG. 13 is a graphical representation of nucleation quality versus power density.

Using the foregoing equations, Nucleation Quality may be predicted for a range of power densities, as depicted in FIG. 13. As shown, Nucleation Quality may drop off sharply in the low power density section A in FIG. 3. Comparing FIGS. 4 and 13 it appears that placement variability may be inversely related to Nucleation Quality, or in other words as Nucleation Quality increases, variability decreases.

Thus, one possible explanation for the relatively greater variability in ink drop velocity exhibited by ink jet print heads operated in the low power density section A of FIG. 3 is that the predominant mechanism affecting ink drop velocity in this range, nucleation not occurring over a large portion of the heater surface at the same time, may carry with it a relatively greater degree of variability. As the effect of this mechanism diminishes as the power density is increased, the other mechanism for affecting ink drop velocity as discussed above for section B of the curve, reduced thermal energy conducted to the liquid ink prior to nucleation, may become more predominant.

Thus, the inherently greater variability that may be associated with the first mechanism may be a large factor in section A of the curve, but a relatively small factor in section B of the curve. Therefore, a possible explanation for the reduced variability in ink drop velocity for ink jet print heads operated in the high power density section B of FIG. 3 has been presented.

The print heads to which the present invention may be applied are constructed according to techniques and methods well known by those with ordinary skill in the art, such as those disclosed in U.S. Pat. No. 5,400,067, to Day, filed on Dec. 10, 1993, which is incorporated herein by reference.

While preferred embodiments of the present invention are described above, it will be appreciated by those of ordinary skill in the art that the invention is capable of numerous modifications, rearrangements and substitutions of parts without departing from the spirit and scope of the appended claims.

What is claimed is:

1. A method of printing with a thermal ink jet printer which comprises the steps of providing a thermal ink jet print head containing a plurality of resistance heaters, each resistance heater having a length and an electrical current path thereto and a flat heater surface for heating ink adjacent the surface of the heater and providing electrical current to the heater through the current path to create by Joule law heating in said resistance heater an ink ejection operational power density of at least about two gigawatts per square meter.

2. The method of claim 1 wherein the heater size ranges from about 25 microns long and about 25 microns wide to about 65 microns long and about 65 microns wide.

3. The method of claim 1 in which said method of printing is by ejecting ink from the print head through a nozzle plate having a plurality of nozzles, each nozzle being associated with one of said resistance heaters and having a nozzle diameter of about 0.8 times said length of said one heater with which each said nozzle is associated.

4. The method of claim 3 wherein each nozzle in the nozzle plate is bell shaped so that the nozzle diameter ranges from about 20 microns to about 52 microns through the nozzle plate.

5. The method of claim 1 wherein the heater power density ranges from about 2.2 to about 3.0 gigawatts per square meter.

6. The method of claim 1 wherein the heater power density ranges from about 3.0 to about 3.5 gigawatts per square meter.

7. The method of claim 1 wherein the heater power density ranges from about 3.5 to about 4.5 gigawatts per square meter.

8. A thermal inkjet print head comprising a plurality of resistance heaters having a planar surface size ranging from about 25 microns in length and about 25 microns wide to about 65 microns in length and about 65 microns wide, each resistance heater being electrically connected to an electrical conduit for providing electrical current to the heaters and an electrical current source for providing electrical current through the conduit to the heaters to create by Joule law heating in said resistance heaters an ink ejection operational power density of at least about two gigawatts per square meter of heater surface area.

9. The print head of claim 8 further comprising a nozzle plate containing a plurality of nozzles, each nozzle being associated with one of said resistance heaters and having a nozzle diameter of about 0.8 times said length of said one heater with which each said nozzle is associated.

10. The print head of claim 9 wherein each nozzle in the nozzle plate is bell shaped so that the nozzle diameter ranges from about 20 microns to about 52 microns through the nozzle plate.

11. The print head of claim 8 wherein the power density of each heater ranges from about 2.2 to about 3.0 gigawatts per square meter.

12. The print head of claim 8 wherein the power density of each heater ranges from about 3.0 to about 3.5 gigawatts per square meter.

13. The print head of claim 8 wherein the power density of each heater ranges from about 3.5 to about 4.5 gigawatts per square meter.

14. A thermal ink jet print head comprising:

an ink reservoir;

an ink supply channel from the reservoir to a plurality of ink ejection chambers;

a resistance heater having a surface adjacent each ink ejection chamber for heating ink in each said ejection chamber;

an electrical conduit attached to each resistance heater for providing electrical current to the heater;

a source of electrical current for providing electrical current to the heaters to create by Joule law heating in said resistance heaters an ink ejection operational power density of at least about two gigawatts per square meter; and a nozzle plate containing a plurality of ink ejection nozzles, each ink ejection nozzle being associated with one of said ejection chambers for ejecting ink from the print head onto a substrate.

15. The print head of claim 14 wherein said surface has a length and each said ink ejection nozzle has a nozzle diameter, said nozzle diameter being about 0.8 times said length.

16. The print head of claim 15 wherein each nozzle in the nozzle plate is bell shaped so that the orifice diameter ranges from about 20 microns to about 52 microns through the nozzle plate.

17. The print head of claim 14 wherein the power density of each heater ranges from about 2.2 to about 3.0 gigawatts per square meter.

18. The print head of claim 14 wherein the power density of each heater ranges from about 3.0 to about 3.5 gigawatts per square meter.

19. The print head of claim 14 wherein the power density of each heater ranges from about 3.5 to about 4.5 gigawatts per square meter.

* * * * *